US007281870B2

(12) United States Patent
Uchida

(10) Patent No.: US 7,281,870 B2
(45) Date of Patent: Oct. 16, 2007

(54) INK JET RECORDING APPARATUS

(75) Inventor: Kota Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/147,178

(22) Filed: Jun. 8, 2005

(65) Prior Publication Data

US 2005/0276644 A1 Dec. 15, 2005

(30) Foreign Application Priority Data

Jun. 9, 2004 (JP) ..... 2004-170878

(51) Int. Cl.
*B41J 11/20* (2006.01)

(52) U.S. Cl. ..... 400/58; 400/56; 400/139; 347/8

(58) Field of Classification Search ..... 400/582, 400/56, 58; 347/8
See application file for complete search history.

(56) References Cited

U.S. PATENT DOCUMENTS

| | | | | |
|---|---|---|---|---|
| 4,773,772 | A * | 9/1988 | Hanna et al. | 400/58 |
| 5,967,677 | A * | 10/1999 | McCue et al. | 400/582 |
| 6,102,509 | A * | 8/2000 | Olson | 347/8 |
| 6,419,409 | B1 | 7/2002 | Ueda et al. | |
| 6,666,537 | B1 * | 12/2003 | Kelley et al. | 347/8 |
| 6,834,925 | B2 | 12/2004 | Ikeda | |
| 2002/0057301 | A1 * | 5/2002 | Ikeda | 347/8 |
| 2004/0008230 | A1 * | 1/2004 | Kelley et al. | 347/8 |
| 2004/0223017 | A1 | 11/2004 | Otsuki | |

FOREIGN PATENT DOCUMENTS

| | | |
|---|---|---|
| JP | 5-50673 | 3/1993 |
| JP | 10-24591 | 1/1998 |
| JP | 2002-96528 | 4/2002 |
| JP | 2002-326346 | 11/2002 |
| JP | 2002-356036 | 12/2002 |
| JP | 2004-122629 | 4/2004 |

* cited by examiner

*Primary Examiner*—Ren Yan
*Assistant Examiner*—Matthew Marini
(74) *Attorney, Agent, or Firm*—Fitzpatrick, Cella, Harper & Scinto

(57) ABSTRACT

An ink jet recording apparatus includes a carriage for reciprocal movement while carrying a recording head for effecting recording by ejecting ink; a platen for supporting recording material at a position opposed to the recording head; a changing member for changing a distance between the recording head and the platen; a detecting member, provided on the carriage, for detecting recording positional deviation by reading a pattern recorded on a recording material by the recording head; a member to be detected that is movable with an operation of the changing member; and a discriminating unit for discriminating a distance between the recording head and the platen by detecting a state of the member to be detected by the detecting member.

5 Claims, 10 Drawing Sheets

INK JET RECORDING APPARATUS

FIELD OF THE INVENTION AND RELATED ART

The present invention relates to an ink jet recording apparatus for effecting recording by ejecting ink onto a recording material by recording means.

A recording device used in a device such as a printer, a copying machine, a facsimile machine or the like, or as output equipment for a combination type electronic equipment or work station including a computer function, word processor function or the like, has a structure for effecting recording of an image on a recording material such as a sheet of paper, a thin plastic resin plate or the like, in response to image information. Such a recording device is classified on the basis of its recording system into an ink jet type, a wire dot type, a thermal type, a laser beam type and the like. In a recording device of a serial type using a serial scanning system, wherein main-scanning operations are repeated in a direction crossing with a feeding direction (sub-scan direction) of the recording material, one line of the image is recorded by the recording means carried on a carriage which moves along the recording material, and thereafter, the sheet is fed by a predetermined distance, and then, the image of the next line is recorded. By repeating such operations, the image is recorded on the entirety of the recording material.

Among such recording devices, an ink jet recording apparatus effects the recording by ejecting ink onto the recording material from recording means (recording head). The ink jet recording apparatus is advantageous in the easiness of downsizing of the recording means, and in that images can be recorded at a high speed with high precision, and in addition, the recording is possible on plain paper which has not been subjected to a special process. Moreover, the running cost is low, and the noise is low since it is a non-impact type printer, and it is easy to record color images using multi-color inks.

Particularly, recording means which ejects the ink using thermal energy can be manufactured through a semiconductor manufacturing process by forming electrothermal transducers, electrodes, liquid passages and the like on a substrate, and therefore, the ejection outlets can be easily manufactured with high density, thus accomplishing a further downsizing. Recently, the demands for the materials of the recording material become wide. For example, the recording material may be normal sheet of paper, a resin material thin plate (OHP or the like), a thin paper sheet, processed paper (sheets having punch holes for filing, paper having perforations, paper having various shapes or the like), or textile, metal or the like.

In order to form clear and high quality recording by the ink jet recording apparatus, it is very important to stably maintain a constant distance between the recording material and the recording means. The recording material may be relatively thin as in plain paper or OHP sheet or may be thick as in an envelope, plastic resin material plate or the like. The thickness of the thick recording material may exceed 1 mm including warping. Since the distance between the recording material and the recording means is normally set to be approximately 1 mm, the user is required to manipulate a lever or the like to increase the distance between the recording means and the recording material (platen) upon the recording on thick recording material. The change of the gap between the recording means and the platen (recording material) is called here "head-platen distance switching".

As regards the head-platen distance switching, there are various methods for detecting whether the head-platen distance is for a thin recording material or for a thick recording material. Japanese Laid-open Patent Application No. 2002-356036 discloses a method in which a position of a switching lever for moving the recording means is detected by a contact type sensor. Japanese Laid-open Patent Application No. 2002-96528 discloses a method in which the height of the carriage carrying the recording means is changed by a switching lever, and the change is detected. Japanese Laid-open Patent Application Hei No. 5-50673 discloses a method in which a platen is vertically moved by an eccentric cam, and the position of the platen is detected.

Recently, again, the sizes of the ink droplets ejected onto the recording material are reduced, and the density of the ejection nozzles is increased, wherein the ink ejection timing from an ejection outlet array (nozzle array) of the recording means is finely adjusted so as to reduce deterioration of the recording quality attributable to deviation of the recording position. As a method, Japanese Laid-open Patent Application No. 2002-326346 discloses that a predetermined pattern is printed, the printed pattern is read by an optical sensor or the like, an adjustment value is calculated from the read value, and the ink ejection timing during recording is adjusted on the basis of the calculated adjustment value.

SUMMARY OF THE INVENTION:

Recently, again, the main assembly of the apparatus of the ink jet recording apparatus is further downsized, and is made thinner with the result of difficulty in providing in an inexpensive manner for the head-platen distance switching mechanism and/or detecting means for the head-platen distance switching to accomplish the change of the head-platen distance, which is the distance between the recording means and the recording material or platen.

Accordingly, the present invention can provide an ink jet recording apparatus wherein use is made of a known recording positional deviation correcting means (registration adjustment sensor or the like) to detect the head-platen distance, so that it is not necessary to add an additional sensor, and the change of the head-platen distance can be detected with a small and inexpensive structure.

According to an aspect of the present invention, there is provided an ink jet recording apparatus comprising a carriage for reciprocal movement while carrying recording means for effecting recording by ejecting ink; a platen for supporting the recording material at a position opposed to the recording means; a changing member for changing a distance between the recording means and the platen; a detecting member, provided on the carriage, for detecting recording positional deviation by reading a pattern recorded on a recording material by the recording means; a member to be detected movable with an operation of the changing member; and discriminating means for discriminating a distance between the recording means and the platen by detecting a state of the member to be detected by the detecting member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
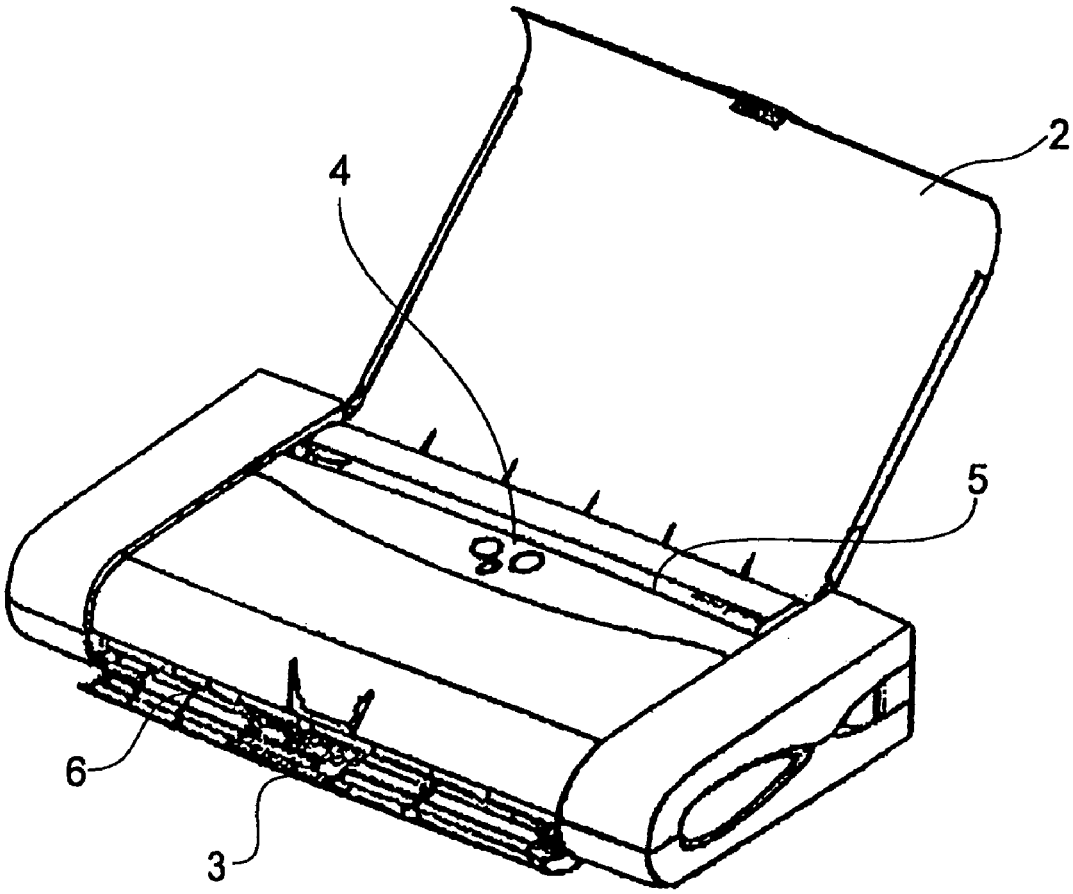
FIG. 1 is a schematic perspective view of an outer appearance of an ink jet recording apparatus according to an embodiment of the present invention.

Referring to the accompanying drawings, the description will be made as to the preferred embodiments of the present invention. The same reference numerals are assigned to the elements having the corresponding functions throughout the drawings. FIG. 1 is a schematic perspective view of an outer appearance of an ink jet recording apparatus according to an embodiment of the present invention. In FIG. 1, designated by reference numeral 2 is a rotatable sheet feeding tray which also functions as a cover; 3 is a rotatable sheet discharge cover; 4 is an operation panel on which a main switch, a LED and the like are disposed; 5 is sheet feeding port for inserting a recording material such as a sheet; and 6 is a sheet discharge opening for permitting discharging of the recording material. When the recording device is not used, the sheet feeding tray 2 and the sheet discharge cover 3 are closed to protect the inside of the main assembly of the apparatus from foreign matter such as dust.

Figure 2:
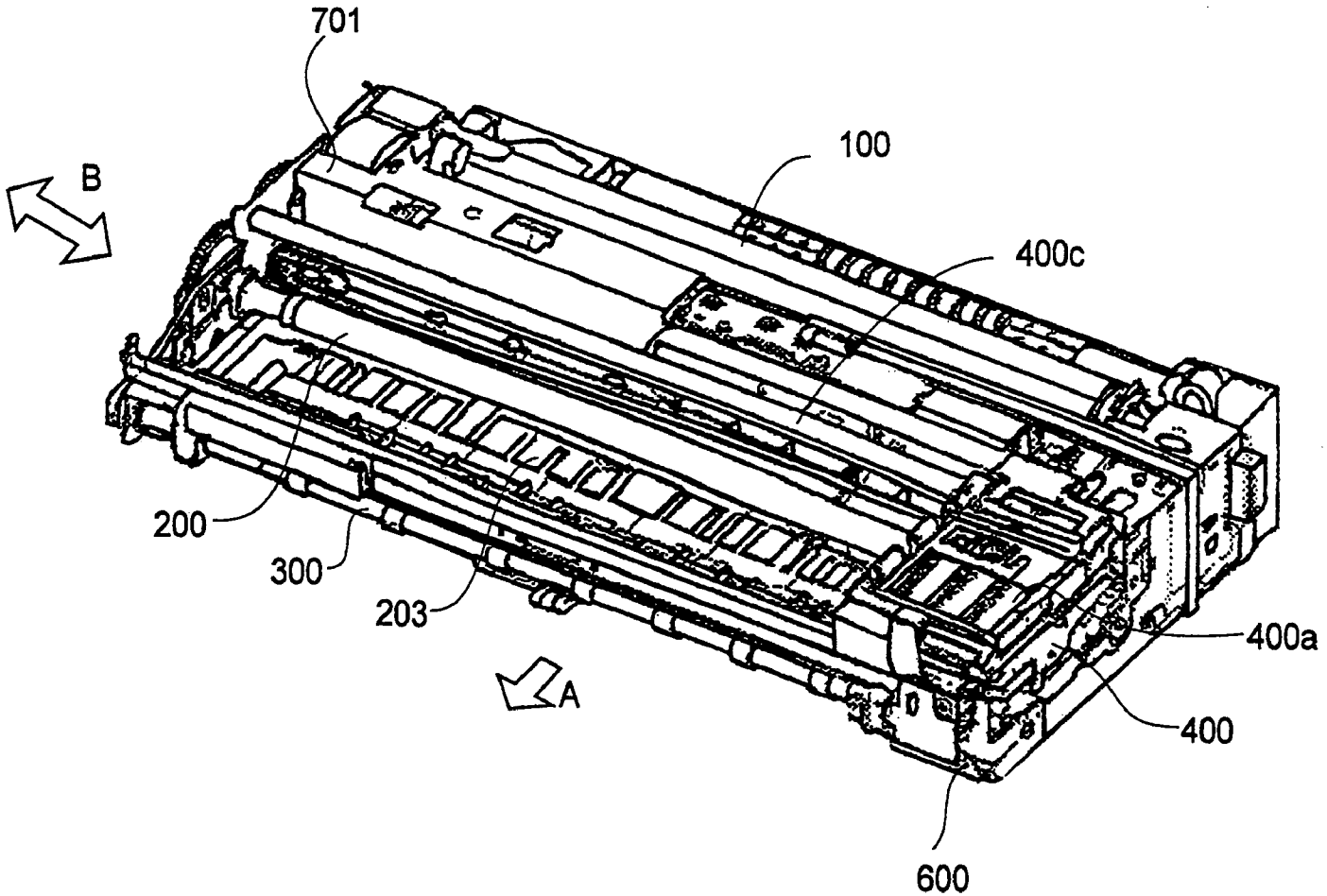
FIG. 2 is a schematic perspective view of an inside structure of an ink jet recording apparatus according to an embodiment of the present invention.

FIG. 2 is a schematic perspective view of an inside structure of an ink jet recording apparatus according to the embodiment of the present invention. In FIG. 2, designated by reference numeral 100 is an automatic sheet feeder; 200 is a feeding portion; 300 is a sheet discharge portion; 400 is a recording portion (carriage portion); and 600 is a recovering mechanism portion. They are mounted on a chassis 701 or the like for proper interrelations among them. The automatic sheet feeder 100 functions to feed the recording material such as a sheet of paper, a plastic resin material sheet or another sheet material, one by one, into the main assembly of the apparatus. The feeding portion 200 functions to feed the recording material fed from the automatic sheet feeder 100 to the recording position and to feed the recording material on which the recording has been effected to the sheet discharge portion 300. The sheet discharge portion 300 functions to feed the recording material now having the record to the outside through the sheet discharge opening 6.

The recording portion 400 includes a carriage 400*b* carrying recording means 400*a* for effecting recording by ejecting the ink onto the recording material, and the carriage 400*b* is reciprocally supported and guided on a guiding shaft 400*c*. The recording means 400*a* is actuated in synchronism with the movement of the carriage 400*b* in response to the image information, by which a desired recording is effected on the recording material which is being fed through the recording by the feeding portion 200. The recovering mechanism portion 600 is provided with refreshing means for maintaining and recovering the ink ejection performance of the recording means 400*a*. At the position opposed to the reciprocal recording portion 400, there is provided a platen 203 for support and guiding the recording material through the recording portion.

In FIG. 2, an arrow A designates a feeding direction of the recording material, and an arrow B designates the reciprocal moving direction (main scan direction) of the recording portion 400. The illustrated ink jet recording apparatus has a thin type structure for mobile convenience, and has a thickness not more than approximately 60 mm in consideration of easy grip by hand, which is approximately 70 mm-120 mm long. An office desk commercially available in European countries normally has a drawer with an inner size sufficient to accommodate letter size files, and, therefore, with a dimension not less than 310 mm. In view of these facts, the ink jet recording apparatus shown in FIGS. 1 and 2 has a thickness of approximately 52 mm, a width of approximately 310 mm and a depth of approximately 174 mm, and, therefore, it can be easily grasped by hand, and can be accommodated in a drawer of a desk. In the apparatus shown in FIGS. 1 and 2, the thickness is relatively small at the lateral side, the front side and the rear side, and among these sides, the sheet discharge opening 6 is disposed at the front side.

Figure 3:
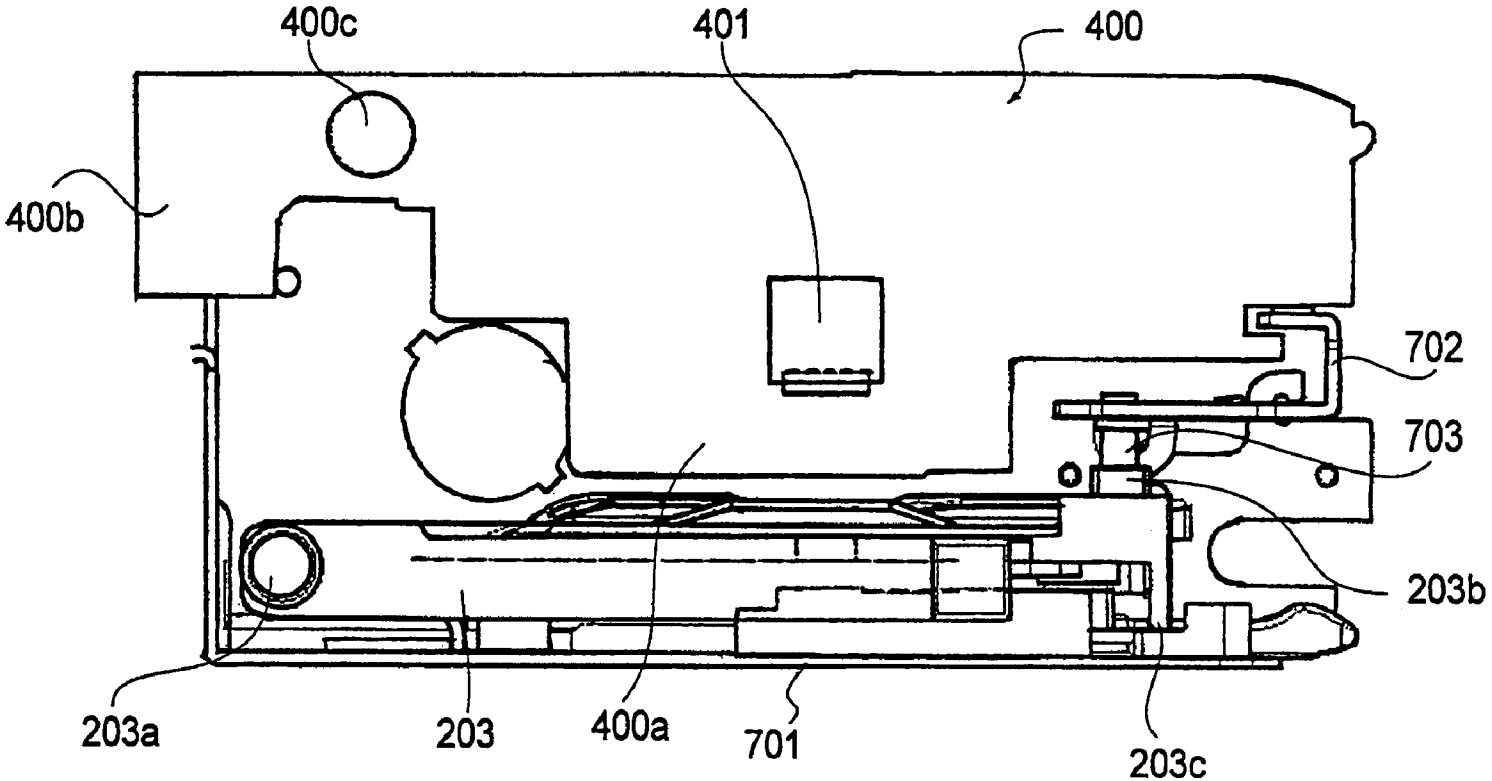
FIG. 3 is a schematic sectional side view illustrating a state of a head-platen distance switching mechanism when the recording is effected on a thin paper such as plain paper, in an ink jet recording apparatus according to an embodiment of the present invention.
Figure 4:
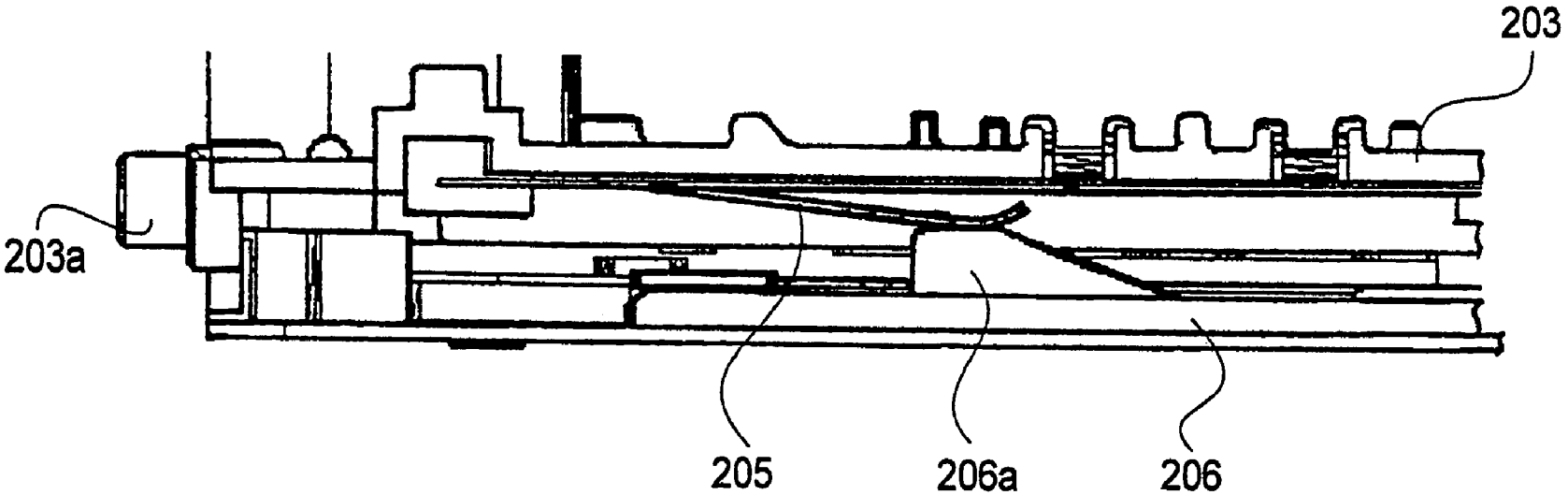
FIG. 4 is a schematic front view of a left (as seen from the front side) part of the head-platen distance switching mechanism used in the apparatus of FIG. 3.
Figure 5:
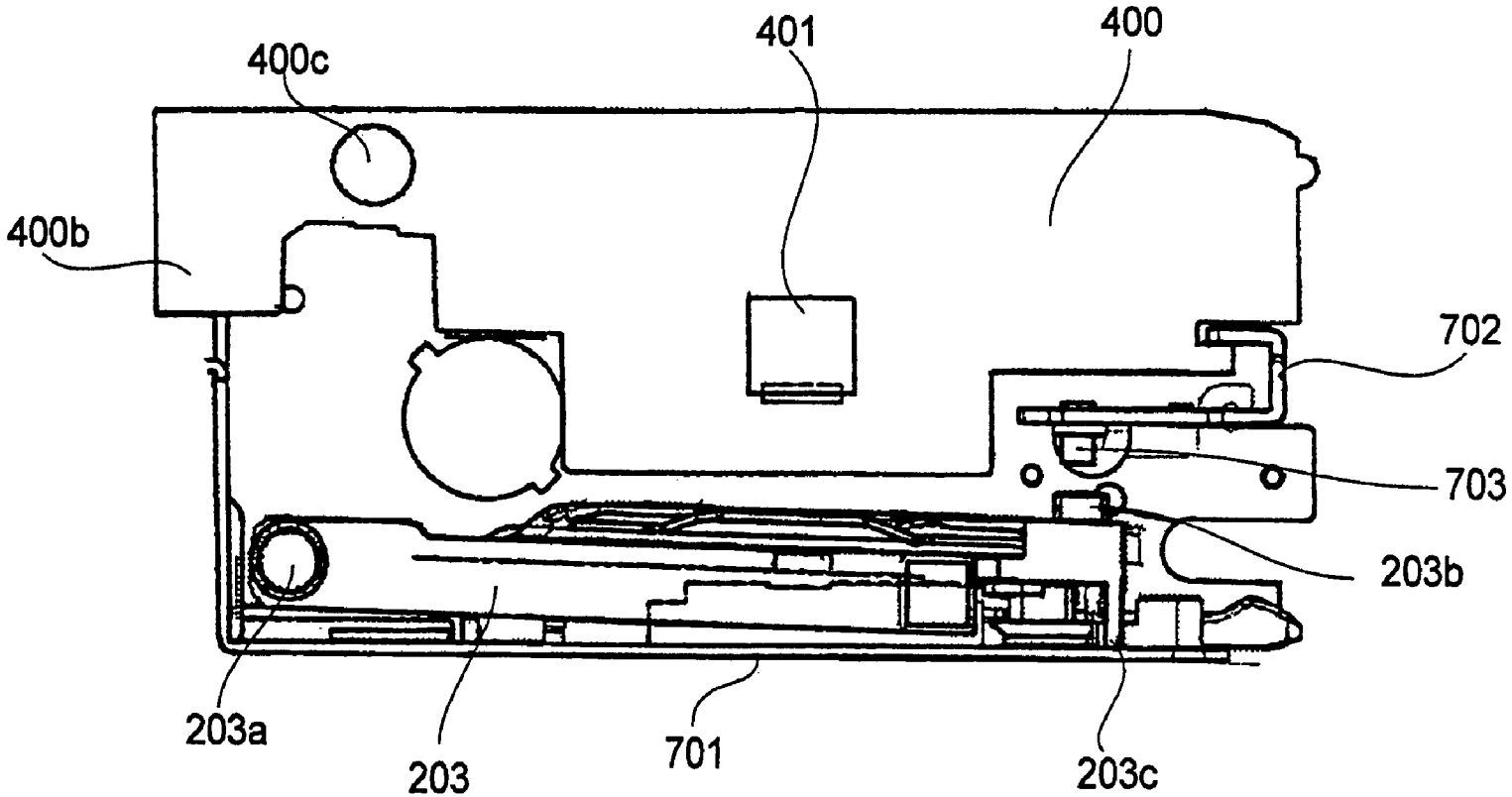
FIG. 5 is a schematic sectional side view of a state of the head-platen distance switching mechanism when the recording is effected on thick paper such as an envelope.

FIG. 3 is a schematic sectional side view illustrating a state of a head-platen distance switching mechanism when the recording is effected on a thin paper such as plain paper, in an ink jet recording apparatus according to an embodiment of the present invention. FIG. 4 is a schematic front view of a left (as seen from the front side) part of the head-platen distance switching mechanism used in the apparatus of FIG. 3. FIG. 5 is a schematic sectional side view of a state of the head-platen distance switching mechanism when the recording is effected on thick paper such as an envelope. FIG. 4 is a schematic front view of a left (as seen from the front side) part of the head-platen distance switching mechanism used in the apparatus of FIG. 5. Referring to FIG. 3-FIG. 6, the description will be made as to the head-platen distance switching mechanism according to this embodiment. In FIG. 3-FIG. 6, the platen 203, disposed at a position opposed to the recording portion 400 in the recording region, is journaled on the chassis 701 for rotation about a center of rotation 203*a*, and by pivoting about the center of rotation 203*a* the gap between the recording means 400*a* and the platen 203 (head-platen distance) at the recording portion (carriage portion) 400 is changeable. The recording portion (carriage portion) 400 has a structure in which the recording means 400*a* is carried on the carriage 400*b*, wherein the carriage 400*b* is supported for sliding movement by the guiding shaft 400*c* and the guiding rail 702, so that carriage 400*b* is reciprocable.

When the recording is effected on thin paper such as plain paper (plain paper printing), the platen 203 is urged upwardly by a head-platen distance switching lever 206 which will be described hereinafter, by which a positioning portion 203*b* of the platen 203 is abutted to a free end of the adjustment screw 703 fixed on the chassis 701 so that vertical position of the platen 203 is regulated. More particularly, below the platen 203, there is provided a head-platen distance switching lever 206 (head-platen distance switching means) having a projected portion (contact portion) 206*a*, and the head-platen distance switching lever 206 is movable or slidable in the left-right direction. The bottom surface of the platen 203 has a leaf spring 205 mounted thereto. By moving the head-platen distance switching lever 206 toward the right hand side as seen from the front side of the recording device, the projected portion 206*a* urges the leaf spring 205 upwardly so as to urge the platen 203 upwardly to bring the positioning portion 203*b* to the adjustment screw 702, by which the vertical position of the platen 203 is determined. In this embodiment, the adjustment screw 702 is fixed on the guiding rail 702 which is provided on the chassis 701 to support and guide the carriage portion 400, but the vertical position of the adjustment screw 702 is adjustable.

In FIG. 3, at a proper position of the recording portion (carriage portion) 400 such as the carriage 400*b* or the recording means 400*a*, there is provided a recording positional deviation detecting means (registration adjustment sensor) 401 for detecting the recording positional deviation of the recording means (recording head) 400*a*. A predetermined pattern is printed by the recording means 400*a*, and the printed pattern is read by the registration adjustment sensor 401. On the basis of the read value, an adjustment value is calculated, and the ink ejection timing from the ejection outlet arrays of the recording means 400*a* is adjusted on the basis of the calculated adjustment value. By doing so, the registration adjustment (the adjustment of the recording positional deviation) is accomplished so that deterioration of the recording quality attributable to the recording positional deviation can be reduced.

Figure 6:
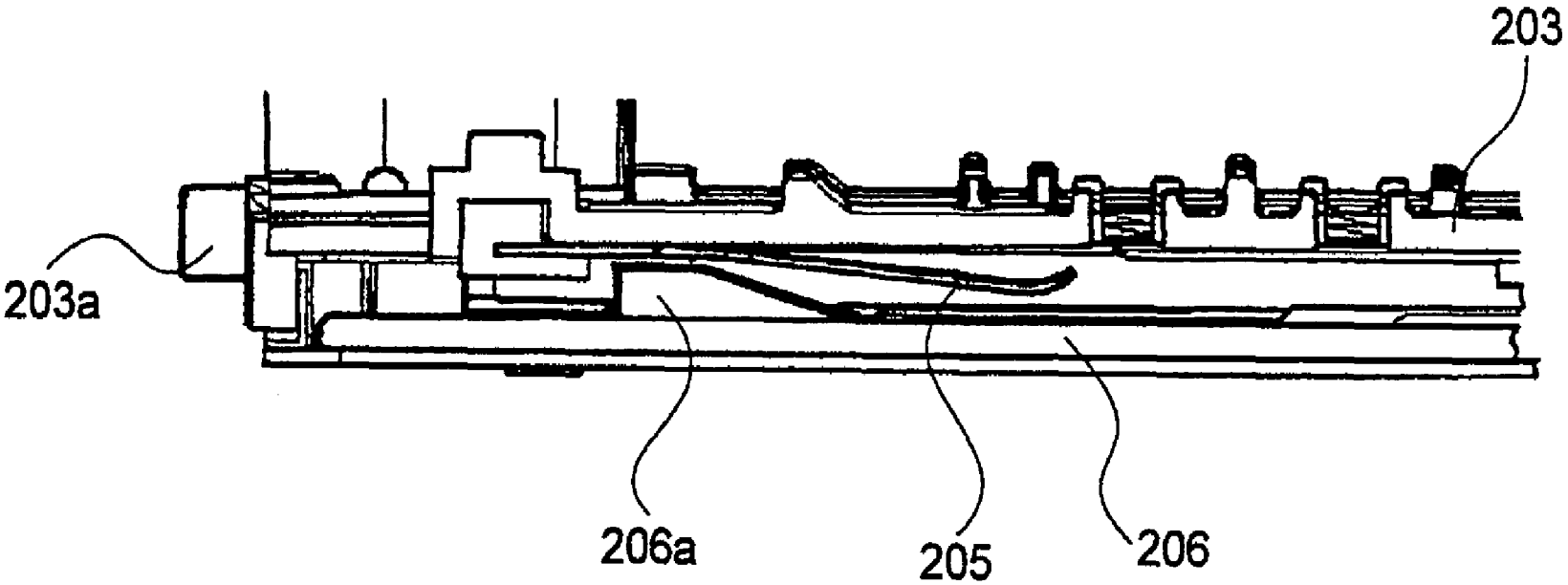
FIG. 6 is a schematic front view of a left (as seen from the front side) part of the head-platen distance switching mechanism used in the apparatus of FIG. 5.

On the other hand, when the printing is effected on thick paper such as an envelope (thick sheet printing), the head-platen distance switching lever 206 is moved to the left hand side as seen from the front side of the recording device. When the head-platen distance switching lever 206 moves to the left, the projected portion 206*a* of the head-platen distance switching lever 206, as shown in FIG. 6, is away from the leaf spring 205, and the platen 203 moves downwardly about the center of rotation 203*a* (lowers). When the platen 203 lowers until the position regulating portion 203*c* of the platen abuts the chassis 701, the vertical position of the platen is regulated. By the head-platen distance switching mechanism having been described in conjunction with FIG. 3-FIG. 6, the head-platen distance can be switched between a distance for the thin paper such as plain paper (plain paper printing) and a distance for the thick paper such as an envelope.

Figure 7:
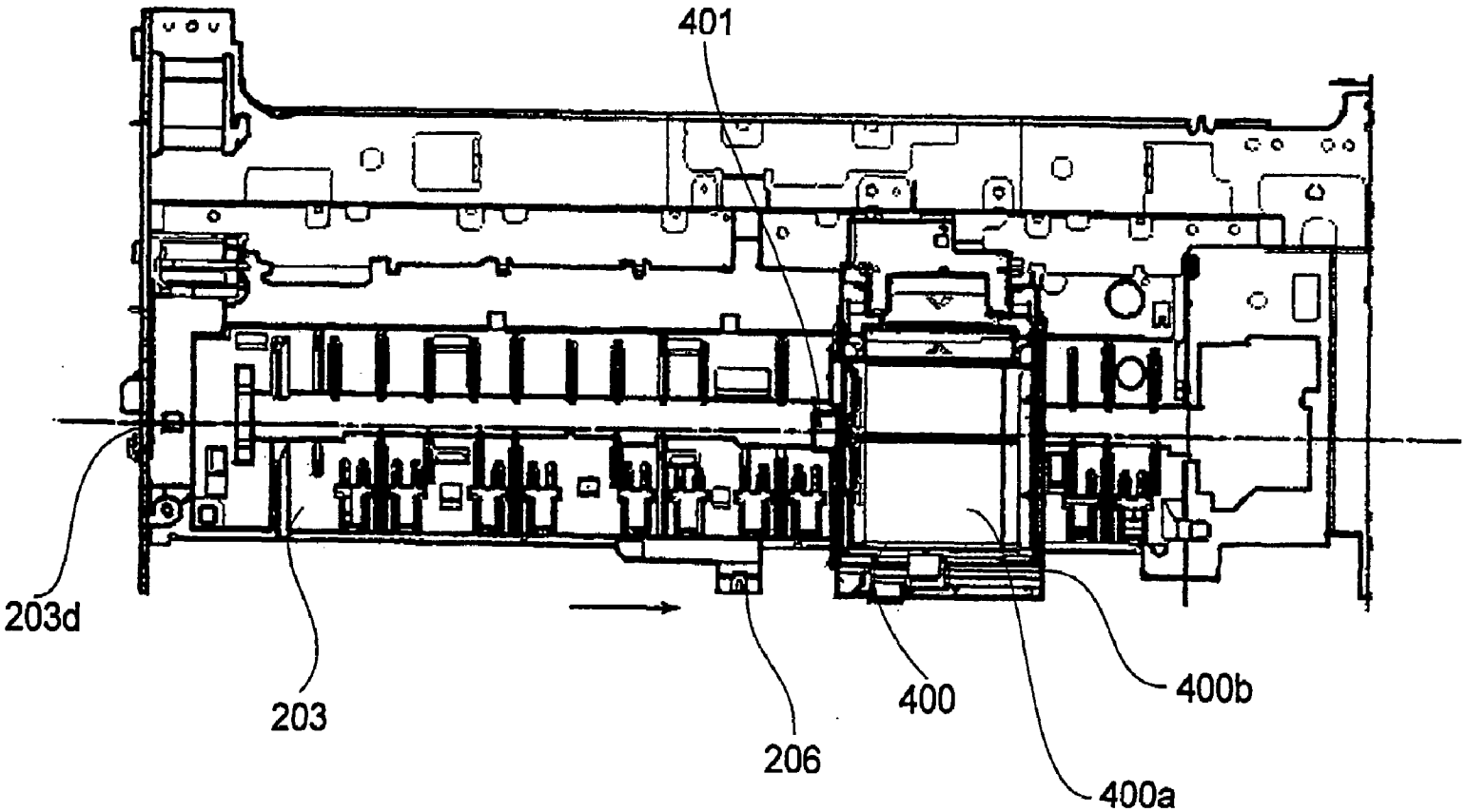
FIG. 7 is a schematic top plan view as seen from above the platen when the recording is effected on plain paper, in an ink jet recording apparatus according to an embodiment of the present invention.
Figure 8:
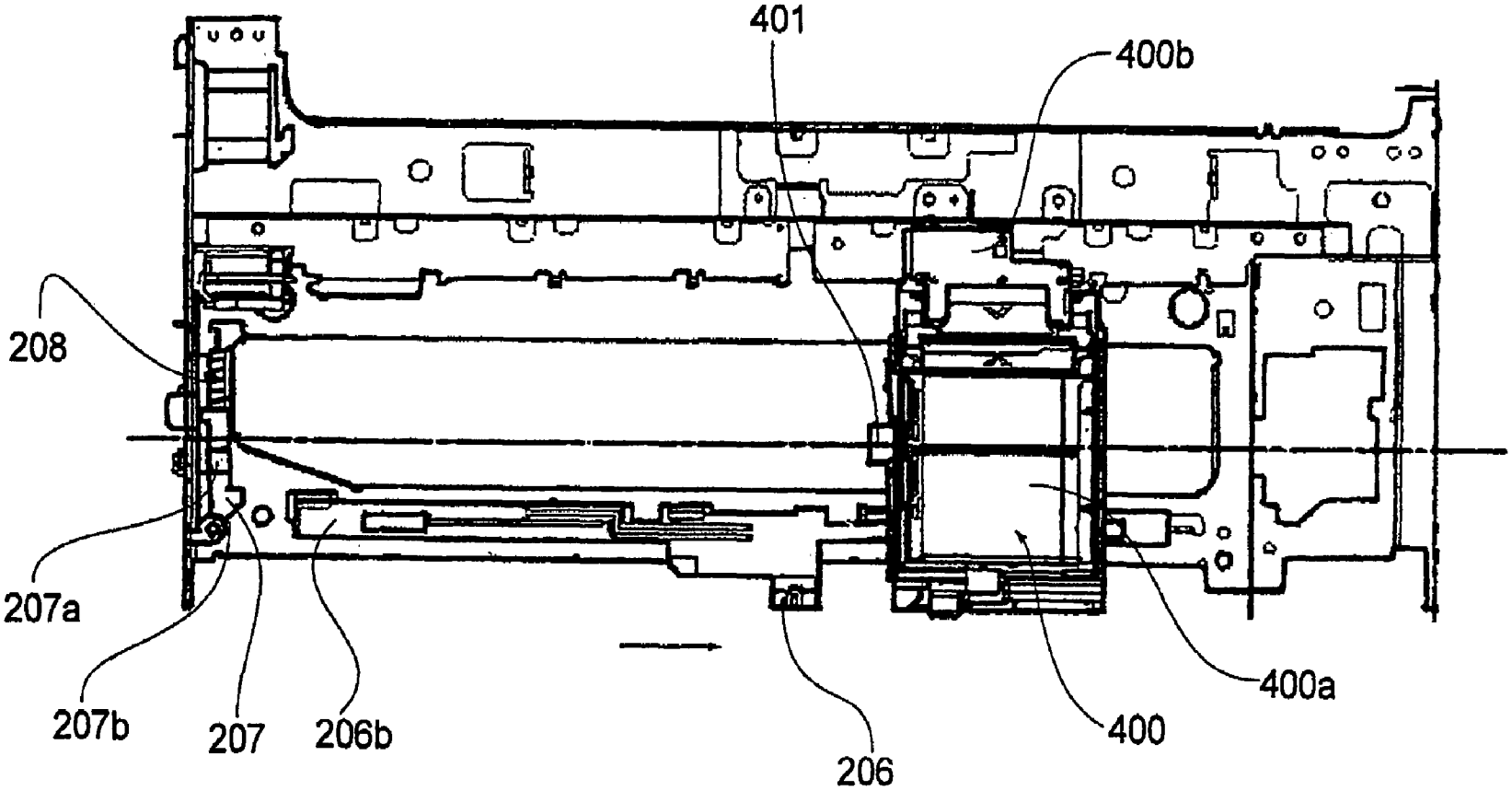
FIG. 8 is a schematic top plan view of a structure of a lower side by omitting the platen from FIG. 7.
Figure 9:
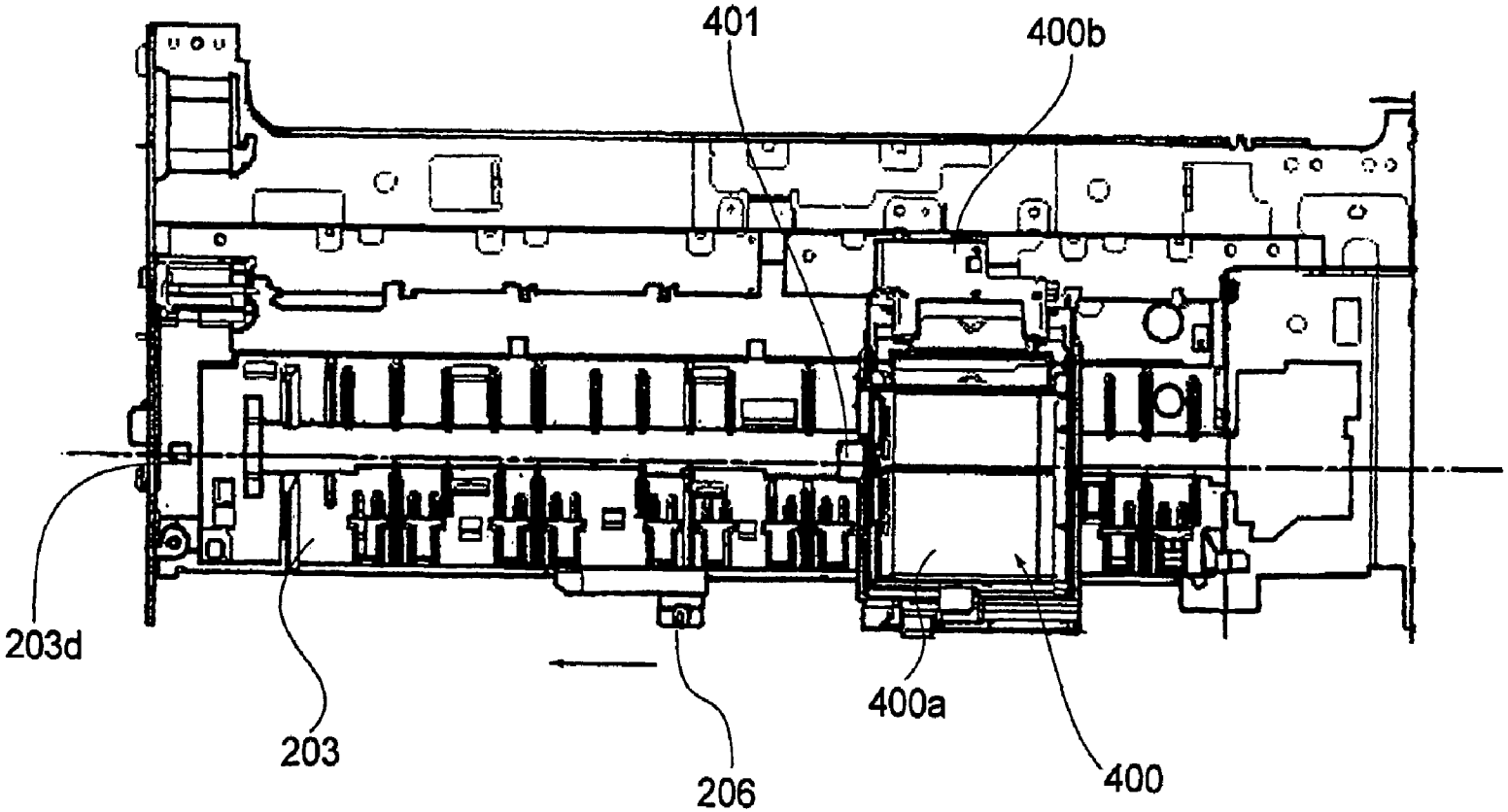
FIG. 9 is a schematic top plan view as seen from above the platen when the recording is effected on a thick sheet, according to an embodiment of the present invention.
Figure 10:
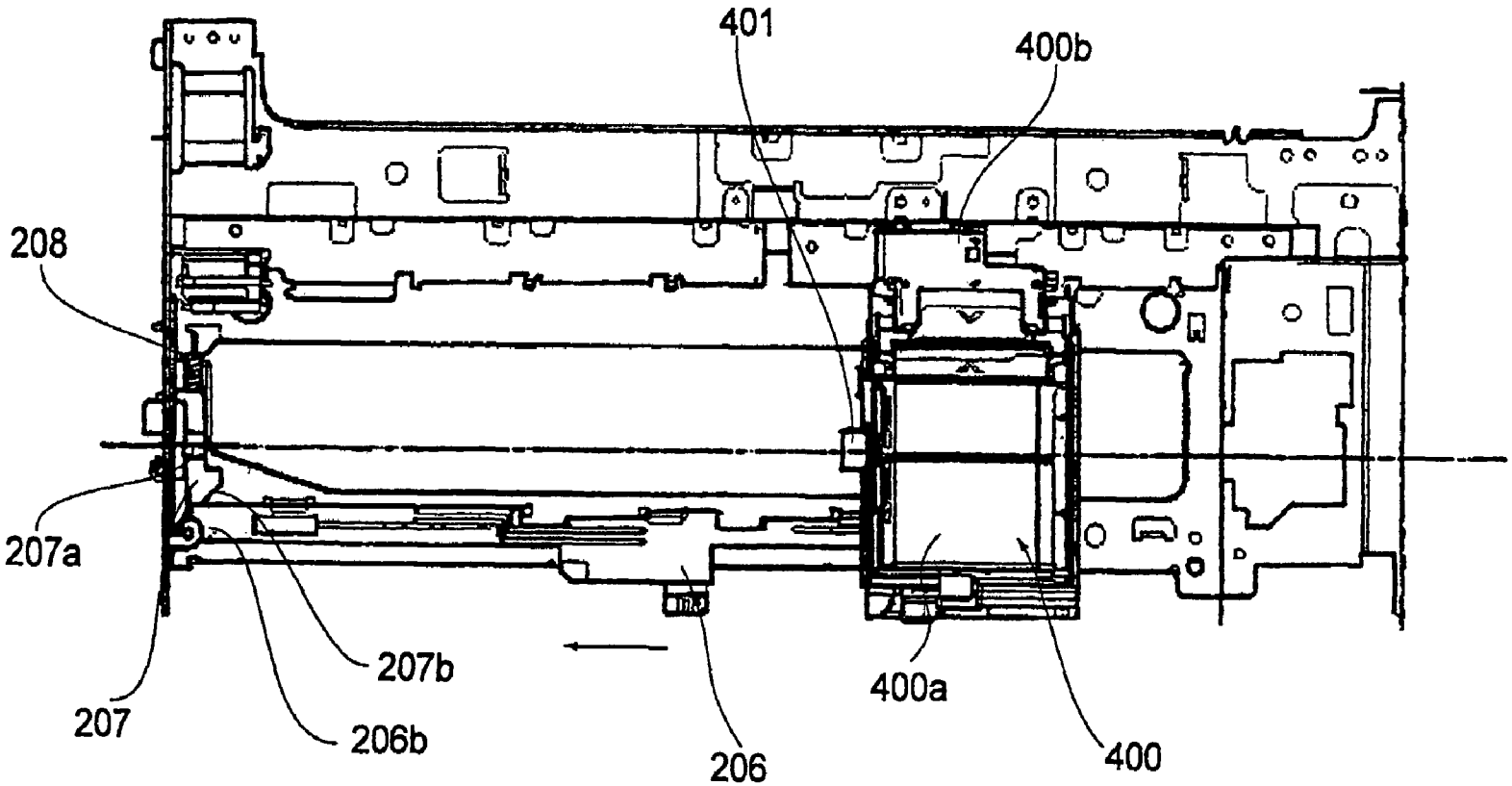
FIG. 10 is a schematic top plan view of a structure of a lower side by omitting the platen from FIG. 9.

FIG. 7 is a schematic top plan view as seen from above the platen when the recording is effected on plain paper, in an ink jet recording apparatus according to an embodiment of the present invention. FIG. 8 is a schematic top plan view of a structure of a lower side by omitting the platen from FIG. 7. FIG. 9 is a schematic top plan view as seen from above the platen when the recording is effected on a thick sheet, according to an embodiment of the present invention. FIG. 10 is a schematic top plan view of a structure of a lower side by omitting the platen from FIG. 9. As shown in FIG. 7-FIG. 10, the platen 203 is provided at a predetermined left-hand end portion in the Figure with a detection hole (opening) 203*d*. The position of the detection hole 203*d* is disposed on the movement path (scanning path) of the registration adjustment sensor 401 provided in the recording portion 400 such that when the recording portion 400 moves to the left side, the registration adjustment sensor 401 is aligned with the detection hole 203*d*. Below the detection hole 203*d* of the platen 203, there is provided a detecting lever 207. The detecting lever 207 is mounted for movement in a direction crossing with (normally perpendicular to) the moving direction of the (carriage portion) 400 and is urged by a compression spring 208 toward the downstream side (downwardly in the Figure) with respect to the feeding direction of the recording material. The detecting lever 207 has a glossy portion 207*a* which has a light reflection property which is higher than that of the other portions. The glossy portion 207*a* constitutes a portion to be detected of the registration adjustment sensor 401 (recording positional deviation detecting means). With such a structure, by moving the head-platen distance switching lever 206 to the left in the Figure, a contact portion 206*b* formed at the left free end of the head-platen distance switching lever 206 is pushed up the inclined surface portion 207*b* of the detecting lever 207 so as to move the detecting lever 207 toward an upstream side with respect to the feeding direction of the recording material (upwardly in the Figure). By the upstream movement of the detecting lever 207, the glossy portion 207*a*, as shown in FIG. 10, is moved to a position where it is opposed to right below the detection hole (opening) 203*d* of the platen 203.

The detection hole 203*d* is formed at a position above the movement path (scanning path) of the registration adjustment sensor 401 provided on the carriage portion 400, as described. Therefore, when the carriage 400*b* is driven to move the recording portion 400 to the left with the state of FIG. 10, that is, the state in which the glossy portion 207*a* is right below the detection hole 203*d* of the platen 203, the glossy portion 207*a* is detected at the position where registration adjustment sensor 401 of the recording portion 400 is aligned with and opposed to the detection hole 203*d*, by which it is detected that platen 203 is at the large head-platen distance position for the thickness sheet (FIGS. 5 and 6).

When the head-platen distance switching lever 206 is moved to the right hand side shown in FIGS. 4 and 7, the head-platen distance switching lever 206 is moved away from the detecting lever 207, as shown in FIG. 8, so that detecting lever 207 is moved toward the downstream with respect to the feeding direction of the recording material by the urging force of the compression spring 208, by which the glossy portion 207*a* is not exposed to the detection hole 203*d* of the platen 203 (offset and undetectable). Thus, even if the carriage portion 400 is moved to the left to align the registration adjustment sensor 401 with the detection hole 203*d*, the glossy portion 207*a* cannot be detected by the registration adjustment sensor 401. By detecting the undetectable state, it is discriminated that platen 203 is at the small head-platen distance position (FIGS. 3 and 4) for the plain paper printing. Thus, by utilizing the registration adjustment sensor 401, which also functions as the recording positional deviation detecting means, the head-platen distance positions (state of switching) can be detected.

According to this embodiment, therefore, when the head-platen distance is to be detected, the carriage 400*b* is moved so as to oppose the registration adjustment sensor 401 to the detection hole 203*a* of the platen 203, the state (position) of the detecting lever 207 is detected utilizing the registration adjustment sensor 401 which is the recording positional deviation detecting means. When it is detected that glossy portion 207*a* is right below the detection hole 203*a*, the head-platen distance is determined as being for the thick paper printing, and when the glossy portion 207*a* is not right below the detection hole 203*a* and therefore is not detected, the head-platen distance is determined as being for the plain paper printing. By such discrimination, the state of the head-platen distance switching of the platen 203 can be detected.

According to the embodiment of the present invention, there is provided an ink jet recording apparatus comprising a carriage for reciprocal movement while carrying recording means 400 for effecting recording by ejecting ink; a platen 203 for supporting the recording material at a position opposed to said recording means; a change member 206 for changing a distance between said recording means and said platen; a detecting member 401, provided on said carriage, for detecting recording positional deviation by reading a pattern recorded on a recording material by said recording means; a member to be detected that is movable with an operation of said changing member; and discriminating means for discriminating a distance between said recording means and said platen by detecting a state of said member to be detected by said detecting member. With such a structure, in an ink jet recording apparatus wherein the platen 203 is displaceable by the head-platen distance switching means 206 to switch the head-platen distance, the head-platen distance, that is, the gap between the platen 203 and the recording means (the change of the gap), can be detected by utilizing the recording portion (carriage portion) 400 and the recording positional deviation detecting means (registration adjustment sensor) 401. Thus, the change of the head-platen distance (head-platen distance position) can be detected without complicating the apparatus and without adding a sensor.

The present invention is applicable, with the similar advantageous effects, to a recording device using a single recording means, a color recording device using a plurality of recording means for effecting recording with different color inks, a tone gradation recording device using a plurality of recording means for effecting recording with the same color but different densities, and to a recording device combining them. The present invention is applicable, with the similar advantageous effects, to a structure using an exchangeable ink cartridge integrally having recording means and an ink container, to a structure using separate recording means and an ink container which are connected with each other by an ink supply tube, and to any other structures of the recording means and ink container. The present invention is suitably usable with the apparatus using recording means having electrical machine conversion member or the like such as piezoelectric elements or the like, but the present invention is particularly suitable to an ink jet recording apparatus using recording means of a type in which the ink is ejected using thermal energy. This is because the high density recording and the high precision recording are possible.

As described in the foregoing, according to the embodiments of the present invention, the head-platen distance can be detected by utilizing the recording positional deviation means (registration adjustment sensor or the like), and therefore, the change in the head-platen distance can be detected with a small size and inexpensive structure without the necessity of adding a sensor.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 170878/2004 filed Jun. 9, 2004, which is hereby incorporated by reference herein.

What is claimed is:

1. An ink jet recording apparatus comprising:

a carriage for reciprocal movement while carrying recording means for effecting recording by ejecting ink;

a platen for supporting a recording material at a position opposed to said recording means;

a changing member for changing a distance between said recording means and said platen by moving said platen;

a detecting member, provided on said carriage, for detecting recording positional deviation by reading a pattern recorded on the recording material by said recording means, an adjustment value being calculated from the detected positional deviation, wherein ejection timing of said recording means is adjusted on the basis of the calculated adjustment value so as to reduce deterioration of a quality of a recorded image;

an opening formed in platen at a position facing a moving path of said detecting member; and a detecting portion, movable to a position where said detecting member can detect said detection portion through said opening in accordance with movement of said platen, for use in determining a position of said platen based on whether said detecting member detects said detecting portion.

2. An apparatus according to claim 1, further comprising a guide shaft for guiding movement of said carriage and a chassis for supporting said guide shaft, wherein said platen is rotatably supported by said chassis.

3. An apparatus according to claim 1, wherein said changing member includes a first lever movable in a direction of movement of said carriage, and by movement of said first lever, a second lever, which supports said detecting portion, is moved in a direction crossing with the movement direction of said carriage.

4. An apparatus according to claim 1, wherein said platen takes a first position at which the distance from said recording means is a first distance, when recording is effected on normal paper, and takes a second position at which the distance from said recording means is greater than the first distance when the recording is effected on thick paper.

5. An apparatus according to claim 4, wherein when said platen is at the first position, said platen is urged toward said recording means by a spring stretched between said platen and said changing member, and wherein when said platen is at the second position, said platen is released from urging of the spring.

* * * * *